US006766932B2

(12) United States Patent
Hansen et al.

(10) Patent No.: US 6,766,932 B2
(45) Date of Patent: Jul. 27, 2004

(54) IDENTIFICATION DOCUMENT AND TICKET CARRIER

(75) Inventors: Linda H. Hansen, Palatine, IL (US); Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 71 days.

(21) Appl. No.: 10/133,515

(22) Filed: Apr. 26, 2002

(65) Prior Publication Data

US 2003/0201293 A1 Oct. 30, 2003

(51) Int. Cl.[7] ..... G09F 3/18

(52) U.S. Cl. ..... 224/604; 224/623; 150/143; 150/145; 40/661

(58) Field of Search ..... 224/603, 604, 224/607, 633, 681–684, 225, 256; 40/1.5, 1.6, 586, 661; 150/138, 143, 145, 149, 134

(56) References Cited

U.S. PATENT DOCUMENTS

| | | | | | |
|---|---|---|---|---|---|
| 1,153,094 | A | * | 9/1915 | McGinty | 150/149 |
| 2,788,040 | A | * | 4/1957 | Hullweck | 150/110 |
| 4,024,660 | A | | 5/1977 | Goto | |
| D252,355 | S | | 7/1979 | Uber | |
| 4,570,688 | A | * | 2/1986 | Williams | 224/604 |
| 4,744,497 | A | | 5/1988 | O'Neal | |
| 4,815,510 | A | * | 3/1989 | Edelist | 150/149 |
| 4,899,879 | A | | 2/1990 | Rosen | |
| 4,955,153 | A | | 9/1990 | Albrecht et al. | |
| 5,178,311 | A | | 1/1993 | McBride | |
| 5,201,525 | A | | 4/1993 | Castro | |
| D343,951 | S | * | 2/1994 | Petty et al. | D3/249 |
| 5,285,833 | A | * | 2/1994 | Haxby | 224/681 |
| 5,388,739 | A | * | 2/1995 | Gargan | 224/604 |
| D365,204 | S | * | 12/1995 | Chen | D3/215 |
| D380,606 | S | * | 7/1997 | Chen | D3/226 |
| 5,829,657 | A | * | 11/1998 | Romer, Jr. | 224/684 |
| 6,108,957 | A | * | 8/2000 | Zapawa | 40/661.08 |
| 2001/0054245 | A1 | * | 12/2001 | Williams | 40/661 |

* cited by examiner

*Primary Examiner*—Nathan J. Newhouse
(74) *Attorney, Agent, or Firm*—Banner & Witcoff, Ltd.

(57) ABSTRACT

A document carrier for travel documents includes a rectangular panel with pockets on one side and a necklace band attached on the opposite side. The band is adjustable and slidable.

7 Claims, 8 Drawing Sheets

IDENTIFICATION DOCUMENT AND TICKET CARRIER

BACKGROUND OF THE INVENTION

The present invention relates to a carrier for identification and travel documentation in the form of a necklace.

With the advent of terrorist activities, various travel restrictions have been implemented for travel by the multiple modes of mass or public transportation. Identification documents such a drivers license, passport, voter registration card as well as a ticket for travel are now a requisite for almost all modes of mass transportation including for airlines, buses, and trains. Attempting to maintain easy access to this documentation while simultaneously attempting to transport and move luggage, coats, jackets, and other materials has become a challenging activity. Thus there has developed a need for providing travelers with a means to access their travel documentation and to maintain such access.

SUMMARY OF THE INVENTION

Briefly, the present invention comprises an identification document and ticket carrier in the form of a necklace. More particularly a rectangular panel includes a plurality of pockets, some of which are transparent. The pockets are arranged on the front side of the panel. The back side of the panel includes a support strand or loop in the form of a cord attached to the back side. The loop may be adjusted in length and placed around the neck of an individual. The attachment of the loop to the back side of the panel insures that the panel will remain properly oriented in use so that the travel documentation in the pockets of the front side is easily accessible. One embodiment of the document carrier includes a fold over cover that enables the traveler to cover or protect the documentation when not needed and thereby provide a measure of privacy.

Thus it is an object of the invention to provide an improved travel document carrier.

It is a further object of the invention to provide a document carrier which enables ease of access to the travel documents and which also provides visibility of those documents without removing them from the carrier.

A further object of the invention is to provide a document carrier which is rugged, attractive, inexpensive and easy to use in combination with standard travel documentation.

These and other objects, advantages, and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
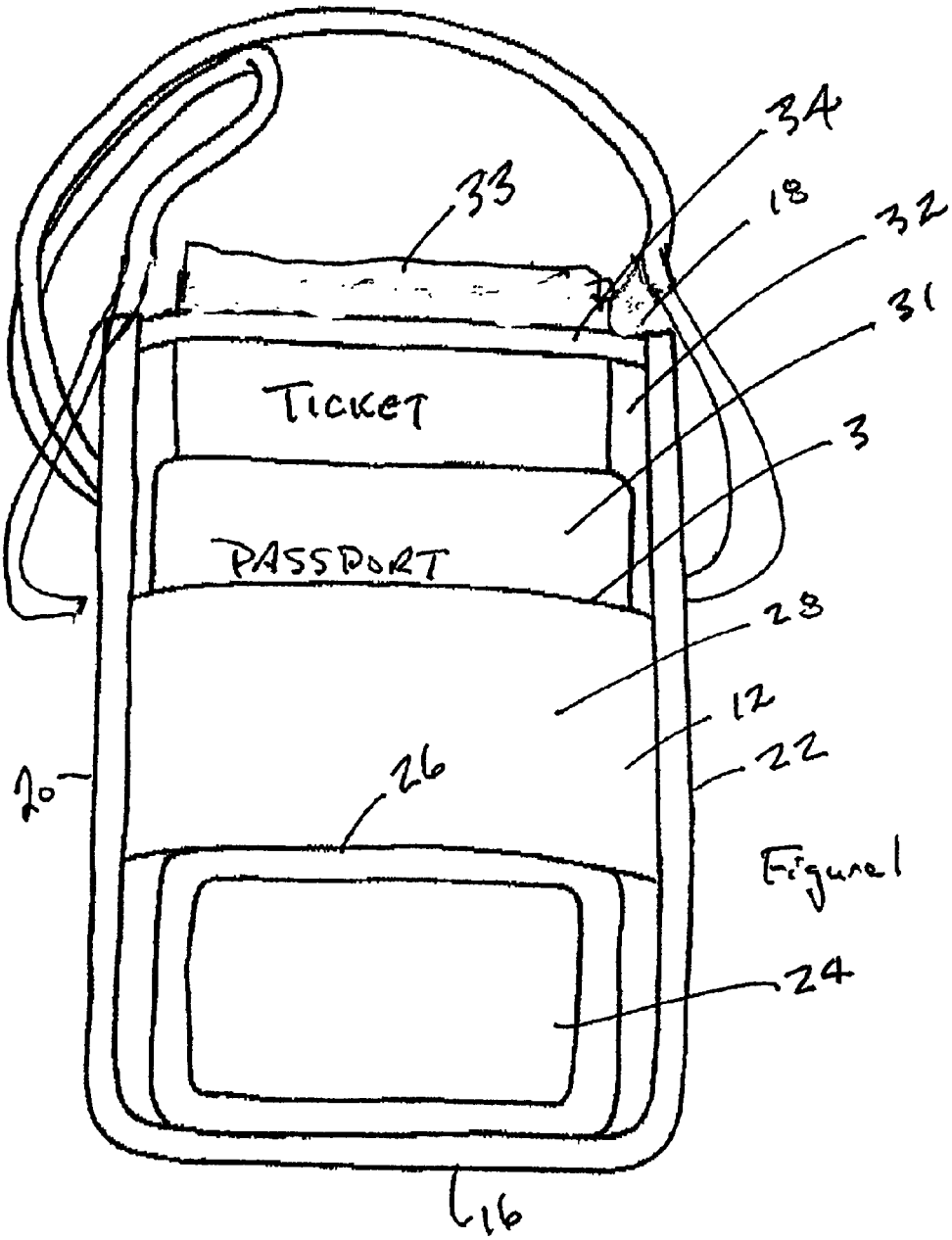
FIG. 1 is an isometric view of the front side of the document carrier in a first embodiment.
Figure 2:
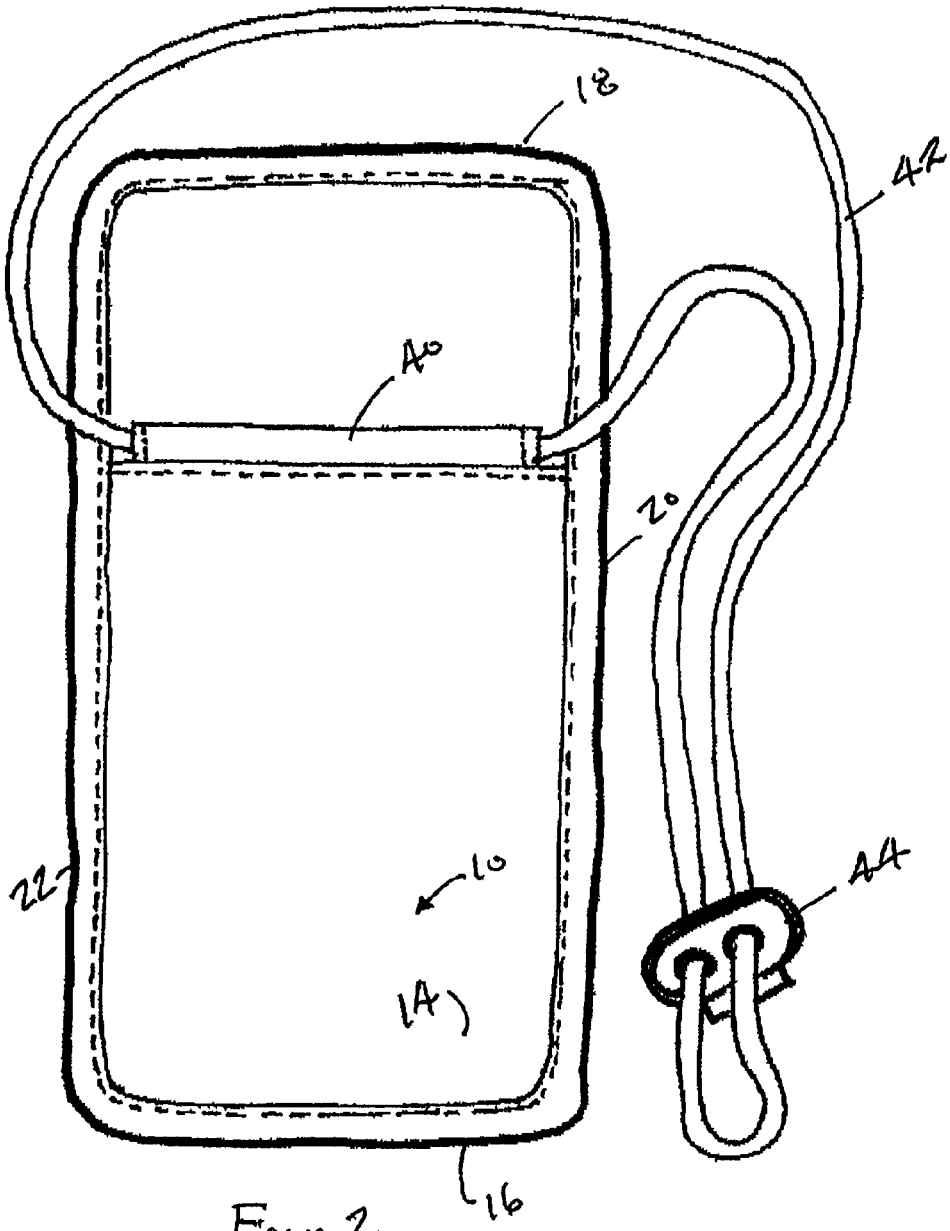
FIG. 2 is an isometric view of the back side of the carrier of FIG. 1.
Figure 3:
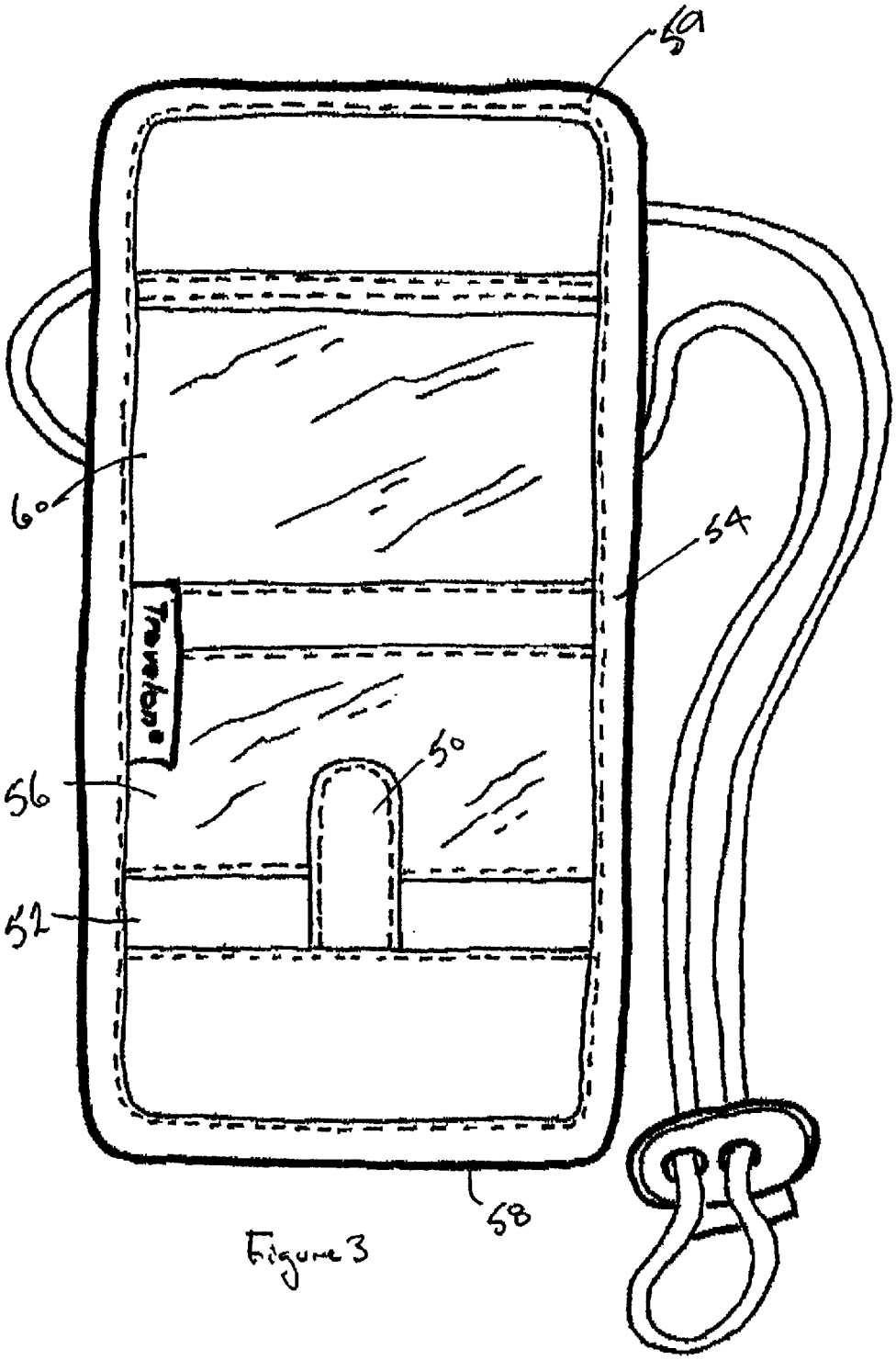
FIG. 3 is an isometric view of the front side of an alternative of second embodiment of the document carrier of the invention.
Figure 4:
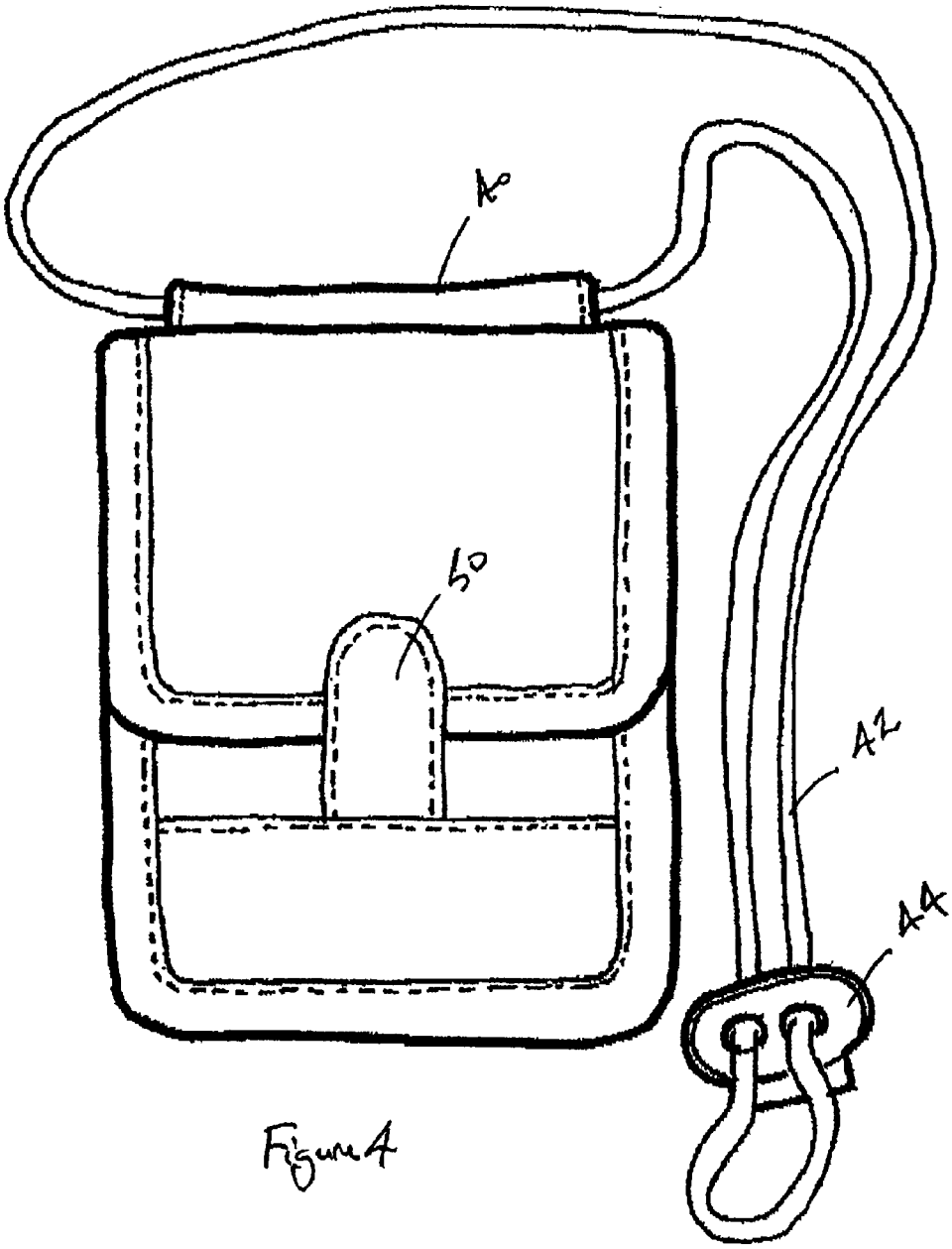
FIG. 4 is an isometric view of the carrier of FIG. 3 wherein the document carrier has been closed or folded in order to protect the security of the documents retained in the carrier.
Figure 5:
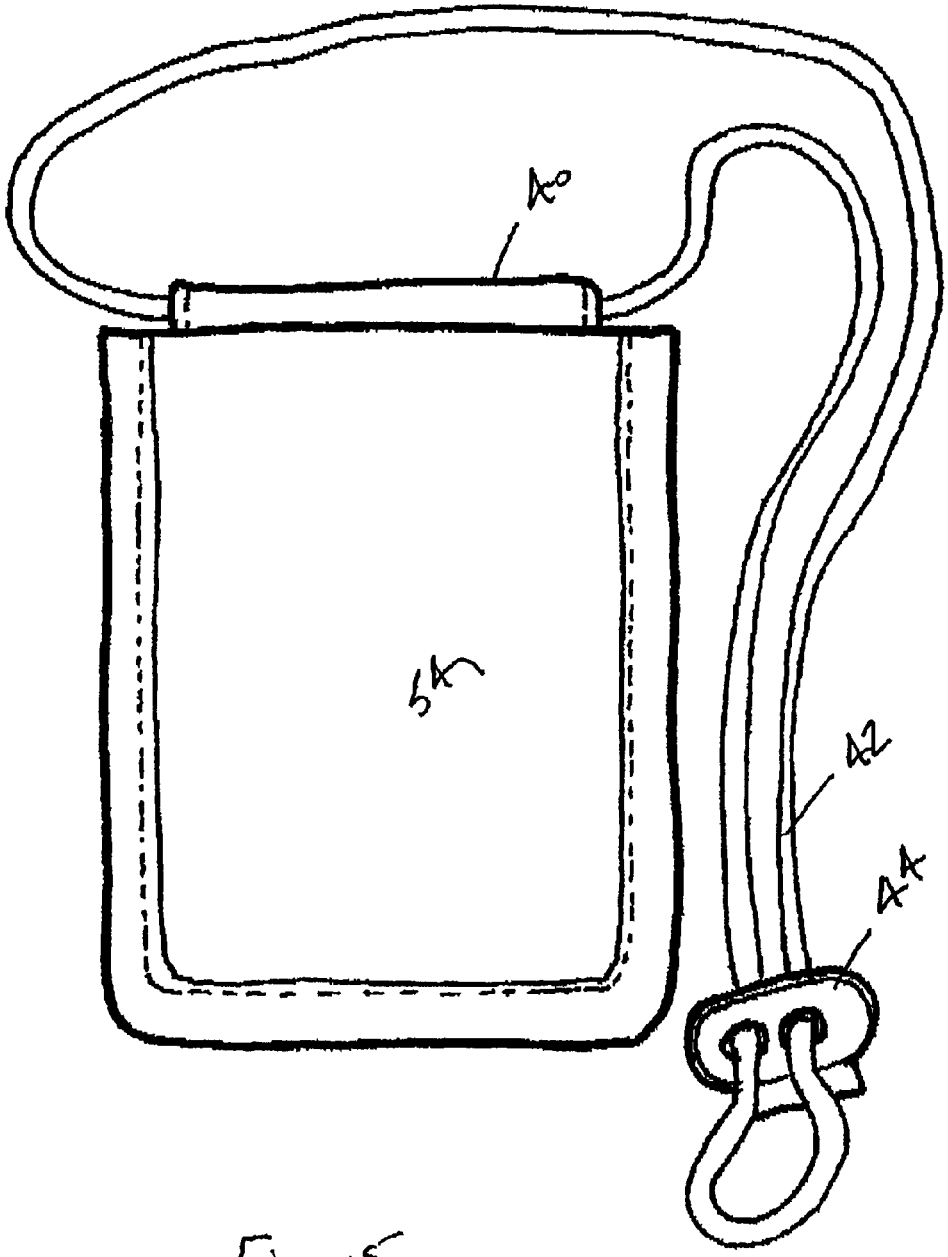
FIG. 5 is a back side view of the folded carrier of FIG. 4.
Figure 6:
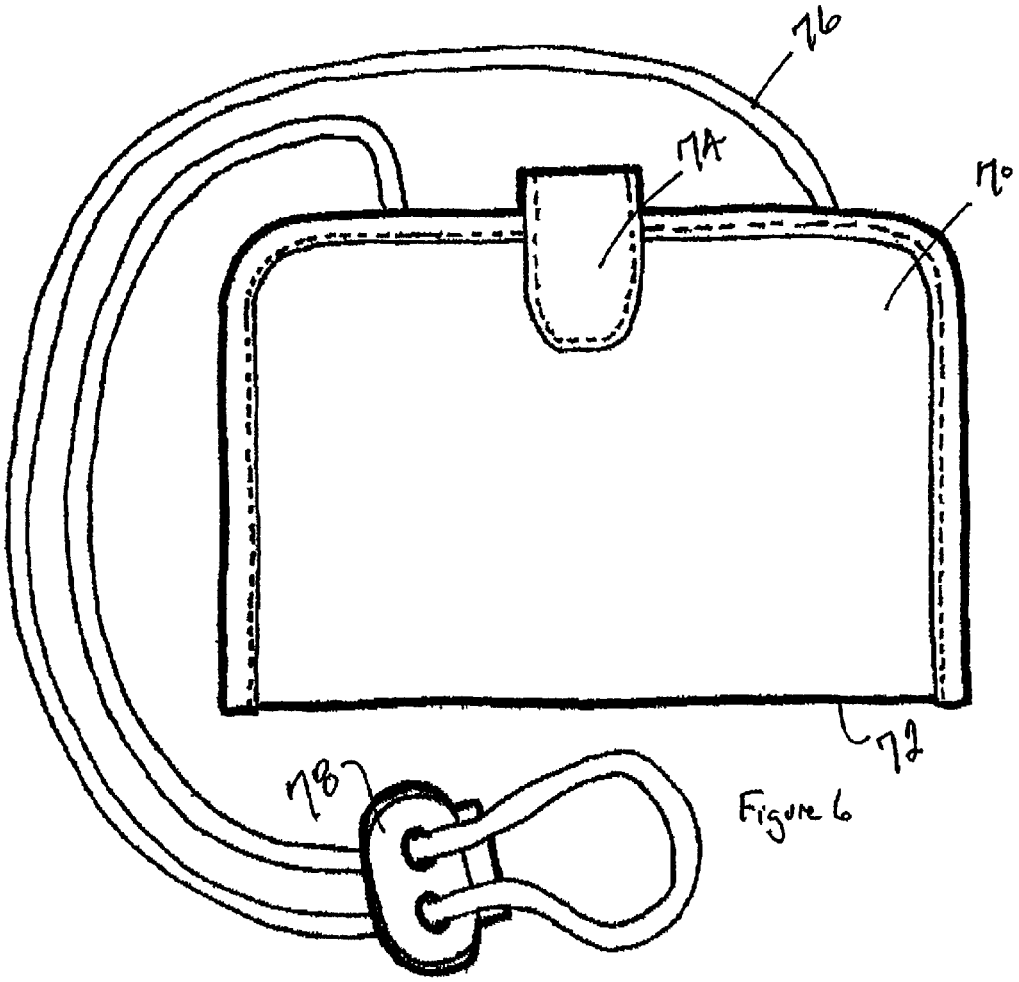
FIG. 6 is an isometric view of a third alternative embodiment of the invention.
Figure 7:
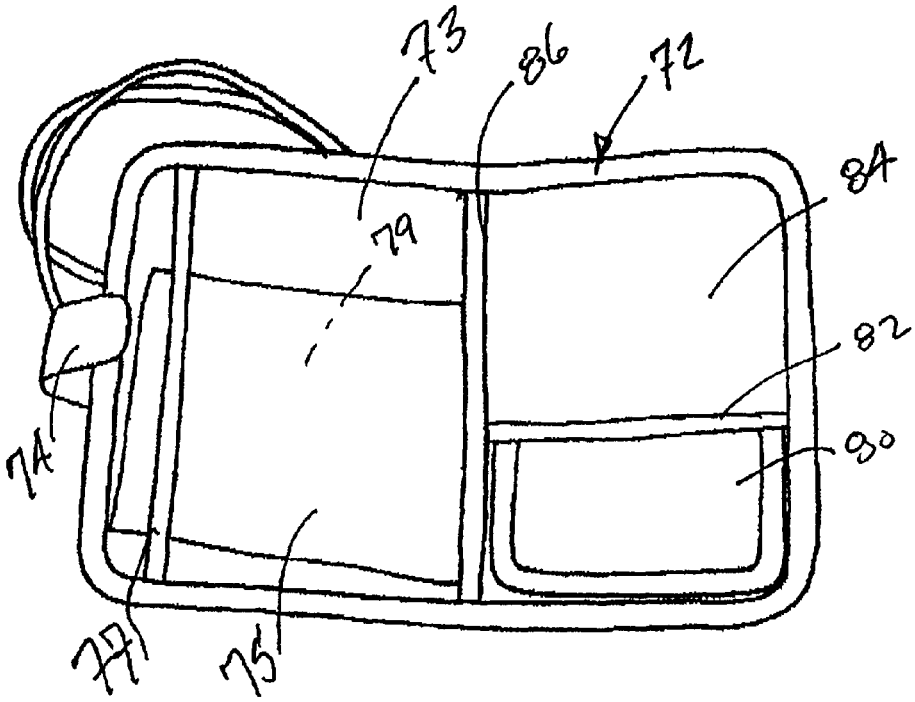
FIG. 7 is an an isometric view of a embodiment of FIG. 6 where the document carrier is in the open position.

Referring to the figures, FIGS. 1 and 2 illustrate a first embodiment of the document carrier. FIGS. 3, 4, and 5 illustrate a second embodiment. FIGS. 6 and 7 illustrate a third embodiment.

Referring to FIGS. 1 and 2, the document carrier comprises a rectangular back panel 10 having a front side 12 and a back side 14. The carrier further includes a bottom edge 16, a top edge 18, a first side edge 20, and a second, parallel side edge 22. The back panel 10 may be made of a heavy fabric material, for example, canvas or some other fabric material. The back panel 10 may also be comprised of inner and outer layers of fabric surrounding a polyethylene or other semi-flexible sheet of material.

The front side 12 of the back panel 10 includes a first transparent pocket 24 which is affixed along three sides or edges to the back panel 10. Thus the first pocket 24, which extends approximately one-third from the bottom edge 16, includes a top edge or side 26 which is open to form a pocket. The first pocket 24 is preferably made from a transparent material so that a travel document may be visibly retained.

A second pocket 28 is also attached to side edges 20 and 22 as well as bottom edge 16 and is open along a top side or edge 30. The top side 30 is not fastened to the back panel 10 whereas the other side edges of the pocket 28 are fastened along the edges 20, 22, and 16 of panel 10. The pocket 28 extends approximately two-thirds of the length of the back panel 10 and is preferably made from a opaque material or fabric. It is sized to receive, for example, a typical passport.

A third transparent material pocket 32 is likewise attached to the first and second edges 20 and 22 as well as the bottom edge 16 and has an open top edge 34 closely adjacent to top edge 18 of the back panel 10. The third pocket 32 is designed to receive, for example, the airline boarding ticket of an individual. Note that the pockets 24, 28, overlie one another and that the pockets 24, 28, and 32 are open for the entire length of the panel upward from the bottom edge 16.

The back side 14 of the panel 10 includes a formed fabric tubular passage 40 which extends between the sides 20 and 22 and which slidably receives a strand or loop of flexible fabric material 42. Thus the strand 42 may be adjustably moved through the passage or loop formed in the back side 14 of the panel 10. The strand or loop 42 includes an adjustment length mechanism or clamp 44 which effectively adjusts the length of the loop formed by the strand 42. By maintaining the strand through the passageway 40 on the back side 14 of the panel 10, the orientation of the panel 10 is maintained when the loop or strand 42 is placed around the neck of an individual. Additionally, by placing the passage 40 approximately one-third of the distance from the top edge 18 to the bottom edge 16, the balance of the panel 10 is maintained for ease of access to the pockets.

Referring to FIGS. 3–5, there is illustrated a second embodiment of the invention. The second embodiment of the invention differs from the first embodiment in that the top one-third of the carrier folds over the middle third and is attached by means of a fastener 50 to retain the carrier in a closed position. This arrangement provides for additional privacy to the user of the carrier. In the embodiment shown the carrier of FIG. 3 includes a pocket 52 which covers the lower two-thirds of the back panel 54. Overlying the top half of the pocket 52 is a transparent pocket 56. Fastener 50 thus attaches below the pocket 56. The pocket 56 is attached to the outside of pocket 52. The pocket 52 extends downwardly to a bottom edge 58 of the back panel 54. A third fully elongate pocket 60 also extends to the bottom edge 58 from adjacent top edge 59. The third pocket 60 may be transparent or opaque. Preferably it is transparent for inclusion of an elongate airline ticket, for example. The remaining construction of the carrier of FIGS. 3–5 is substantially the same as the first embodiment depicted in FIGS. 1 and 2. Nonetheless various differences and alternative features may be incorporated in the carriers. The shape and number of the pockets may be varied. The pockets may be transparent or opaque. The carrier may be folded into equal sized sections or parts rather than one third as depicted in FIGS. 3–5.

A third embodiment of the invention is depicted in FIGS. 6 and 7. In the third embodiment, a document carrier comprised of equally sized generally rectangular panels including a front panel 70 which folds over a back panel 73 along a fold line 72 and which may be fastebed by means of a clip or fastener 74. A cord 76 is retained in a pocket (not shown) in the outside of the back side panel 73. The cord 76 includes an adjustable clamp 78.

The inside or front side of the panel 72 includes a transparent pocket 80 with an open top edge 82. The panel 72 further includes a pocket 84 which underlies the pocket 80 and which covers the entire inside surface of the panel 72. Pocket 84 has an open top edge 86. Preferably the storage pocket 84 is made from an opaque fabric material.

The opposite side or back panel 73 in FIG. 7 includes a transparent pocket 75 with an open top edge 77. In this manner a ticket for example, ticket 79 may be placed in the pocket 73. The embodiment of FIGS. 6 and 7 is retained in the closed position by means of a strap or fastener 7.

Figure 8:
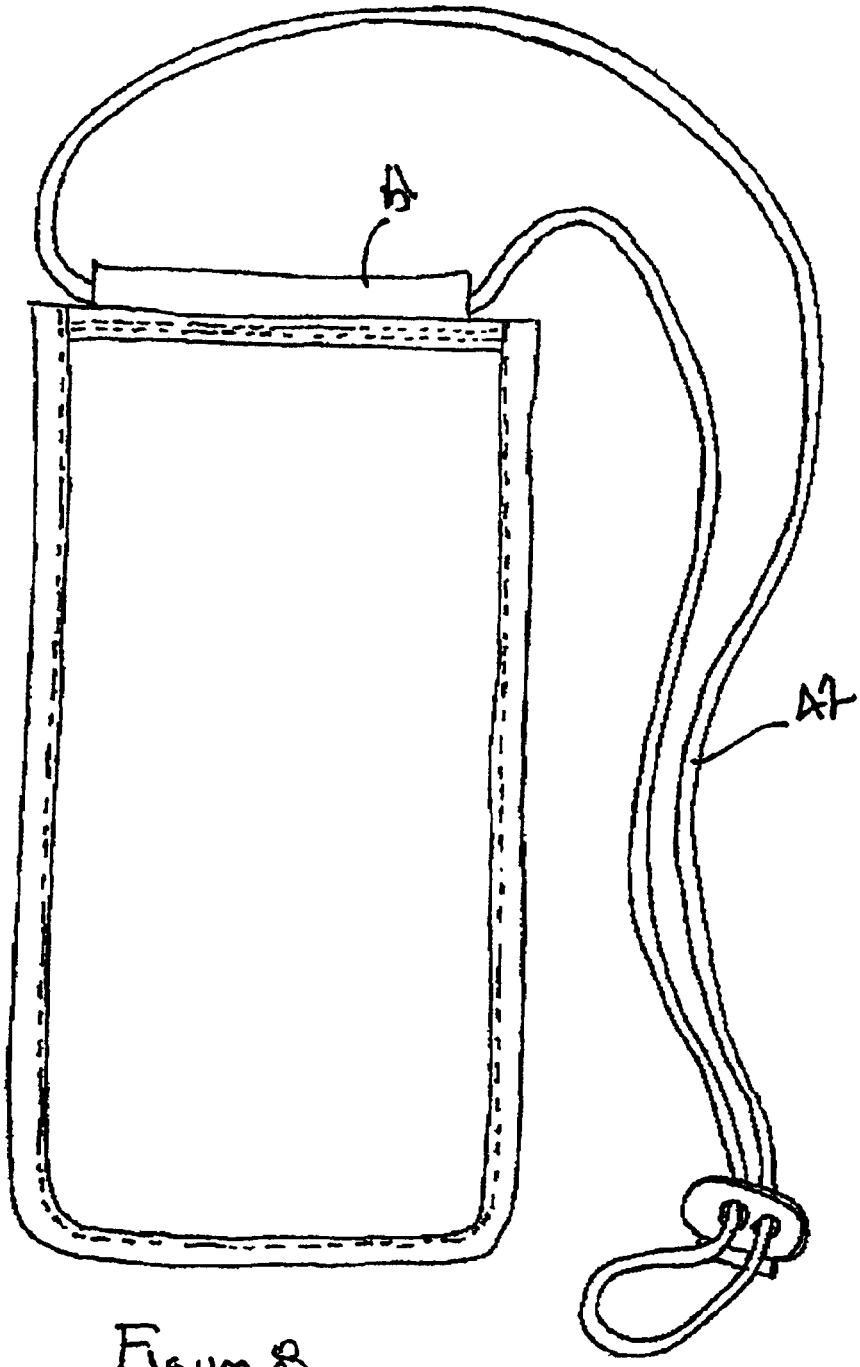
FIG. 8 is an alternative construction for attachment of the loop to the back panel of the carrier for the embodiment of FIGS. 1 and 2.

Various alternatives to the arrangement of the pockets may be provided with respect to the embodiments of FIGS. 6 and 7. Also, as illustrated in FIG. 8, the strand or loop 42 may be attached along the top edge on the back side of the embodiment of FIG. 1 through a cylindrical tube 51 sewn into the top edge. Thus the invention is to be limited only by the following claims and equivalents thereof.

What is claimed is:

1. A necklace and document carrier comprising, in combination:

a generally rectangular back panel, said panel including a back side and a front side, said back panel having a top edge, first and second spaced side edges and a bottom edge, and further including a plurality of pockets extending between edges on the front side, each of said pockets being open along the side of the pocket most closely adjacent the top edge of the back panel, at least one of said pockets formed from a generally transparent material;

a flexible attachment strand attached to the back side of the back panel between the first and second side edges and intermediate the top side edge and the bottom side edge, said strand forming a closed loop and including an adjustable clamp member for controlling the length of the loop;

the back panel being flexible and including a fastener for attaching the top edge to the front side of the back panel to fit over the open sides of the pockets; and said carrier including a transparent material pocket fitted over an opaque material pocket, said transparent material rocket overlying the opaque material pocket and having a lower edge attached to the opaque material pocket, said fastener being intermediate the transparent pocket lower edge and the bottom edge of the back panel whereby the back panel may be folded over and cover the transparent pocket.

2. The carrier of claim 1 wherein said back side of the back panel includes a tubular member for the strand extending between the side edges of the back panel.

3. The carrier of claim 1 wherein the front side of the back panel includes at least two pockets, overlying each other, each pocket having a bottom edge attached at the bottom edge of the back panel.

4. A necklace and document earner comprising, in combination:

a generally rectangular back panel, said panel including a back side and a front side, said back panel having a top edge, first and second spaced side edges and a bottom edge, and further including a plurality of at least two pockets extending between edges on the front side, said pockets each being open along a top side most closely adjacent the top edge of the back panel, a first one of said pockets comprising a pocket panel formed from a generally transparent material and overlying the other pockets on the front side, at least one of said other pockets comprising a pocket panel formed from an opaque material, all of said pockets extending to the bottom edge and thereby overlying each other, each top side of each successive pocket being positioned closer to the top edge than the top side of the next adjacent overlying pocket;

a flexible attachment strand attached to the back side of the back panel between the first and second side edges and intermediate the top side edge and the bottom side edge, said strand forming a closed loop and including an adjustable clamp member for controlling the length of the loop.

5. The carrier of claim 4 wherein the back panel is flexible and including a fastener for attaching the top edge to the front side of the back panel to fit over the open sides of the pockets.

6. The carrier of claim 4 wherein said back side of the back panel includes a tubular member for the strand extending between the side edges of the back panel.

7. The carrier of claim 4 including three pockets, said outside pocket comprising a transparent pocket panel, the intermediate pocket comprising an opaque pocket panel and the next inside panel comprising a transparent pocket panel material.

* * * * *

UNITED STATES PATENT AND TRADEMARK OFFICE

CERTIFICATE OF CORRECTION

PATENT NO. : 6,766,932 B2
APPLICATION NO. : 10/133515
DATED : July 27, 2004
INVENTOR(S) : Linda H. Hansen et al.

It is certified that error appears in the above-identified patent and that said Letters Patent is hereby corrected as shown below:

In the Claims:

Column 4, line 11, in claim 1, "rocket" should be changed and corrected to read --pocket--; and line 24, in the preamble of claim 4, "earner" should be changed and corrected to read --carrier--.

Signed and Sealed this
Twenty-fourth Day of March, 2015

Michelle K. Lee

Michelle K. Lee
*Director of the United States Patent and Trademark Office*